US005809682A

United States Patent [19]

Richert

[11] Patent Number: 5,809,682

[45] Date of Patent: Sep. 22, 1998

[54] LARGE CALIBRE FIREARM

[76] Inventor: Pierre Richert, 18 Rue du General Gouraud, Montigny Les Metz, France, 57158

[21] Appl. No.: 895,532

[22] Filed: Jul. 17, 1997

Related U.S. Application Data

[63] Continuation of Ser. No. 640,728, filed as PCT/FR93/01093 Nov. 5, 1993 published as WO95/12799 May 11, 1995, abandoned.

[51] Int. Cl.[6] ..... F41A 3/58; F41A 3/60

[52] U.S. Cl. ..... 42/75.04; 42/103; 42/42.01; 89/126

[58] Field of Search ..... 42/75.04–8, 36, 42/103, 38, 42.01, 42.02, 42.03; 89/16, 25, 14.05, 1.41, 1.702, 126

[56] References Cited

U.S. PATENT DOCUMENTS

| | | | |
|---|---|---|---|
| 325,053 | 8/1885 | Chuchu | 42/8 |
| 837,867 | 12/1906 | Mossberg | 42/8 |
| 2,076,927 | 4/1937 | Weber | 42/1.16 |
| 4,648,192 | 3/1987 | Harness | 42/75.04 |
| 4,939,863 | 7/1990 | Alexander et al. | 42/103 |
| 5,421,114 | 6/1995 | Bond et al. | 42/42.03 |
| 5,617,665 | 4/1997 | Hoenig | 42/8 |

FOREIGN PATENT DOCUMENTS

| | | | |
|---|---|---|---|
| 1093339 | 5/1955 | France | 42/75.04 |

*Primary Examiner*—Stephen M. Johnson
*Attorney, Agent, or Firm*—Wall Marjama & Bilinski

[57] ABSTRACT

The invention is related to a firearm having a plurality of barrels with a hinged breech block and handle with the handle acting as a grip. The handle is arranged so that it is aligned with the barrel when the breech block is in a closed position.

8 Claims, 6 Drawing Sheets

LARGE CALIBRE FIREARM

This is a continuation of application Ser. No. 08/640,728, filed as PCT/FR93/01093 Nov. 5, 1993 published as WO95/12799 May 11, 1995, now abandoned.

BACKGROUND OF THE INVENTION

The invention relates to the technical field of guns for firing large-calibre projectiles.

This type of weapon is well known to a specialist. However, existing models are generally of large overall dimensions and are not designed to be easily transportable in compact cases. In addition, in order to allow a satisfactory fit against the shoulder during firing, the stock of the weapon must have a special shape, thus making the entire weapon not very compact or ergonomic. Such a design makes it necessary to use a trigger or triggers in the lower part and to fit the weapon with a fore-end, generally at the level of the barrels.

Patent FR-A-2110907 discloses a large-calibre firearm comprising one barrel and a grip having, on its upper part, a single inverted trigger arranged in alignment with the barrel. This document concerns a weapon of a special design having a single barrel.

SUMMARY OF THE INVENTION

The present invention concerns a particularly compact and ergonomic large-calibre firearm with, in particular, double over and under barrels that swivel through 180° designed to allow the optional mounting of a third small-calibre rifled barrel that fires a powerful small-arm munition (short model) or a flat-trajectory munition (long model with stock), the weapon being fitted with a single trigger even if it has three barrels.

In contrast to the systems usually employed by the Police or forces of law and order, the invention provides a variety of immediately-available resources which allow a graduated response or intervention.

The design of the two models (hand-held and shoulder-fired) according to the invention allows transport in extremely compact cases, e.g. 46×24×8 cm (shoulder-fired model with 45 cm barrels) or 24×24×8 cm (hand-held model with 20 cm barrels).

All the projectiles that can be fired from the large-calibre barrels use the same flexible plastic case that can withstand the low pressure of the propellent gases released by a blank cartridge placed in a diffuser chamber that opens out axially or perpendicularly into the nominal bore and which is positioned manually behind the main cartridge.

The device for distributing the propellent gases and their low pressure make it possible to fire projectiles that have a fragile jacket and this reduces the mass of the structure by increasing the active-ingredient capacity of grenades having an incapacitating effect whilst preventing the formation of dangerous shrapnel when using the crowd dispersal gun.

According to one basic aspect of the invention and in order to solve the problem of facilitating transport and producing a compact weapon, in the case of double over and under barrels, the grip is arranged in coaxial alignment with the barrels without extending above the overall dimension of said barrels, it being possible to fold the barrels through an angle of 180° so they are positioned alongside and essentially parallel to the grip acting as a stock.

Another problem that the invention intends to solve is the ability to fire any of the rounds using only a single trigger.

For this purpose, the single inverted trigger is controlled by two cross-mounted levers that actuate either one or the other of the corresponding sears depending on the position of a selector.

Provision is also made to fit the two over and under barrels with a third rifled barrel.

In this case, the trigger system for large-calibre firing comprises a limit stop that restricts the travel of the trigger to essentially 2 mm, i.e. approximately ⅓ of the travel needed to fire the rifled round when the selector is in its middle position, thus excluding the possibility of any simultaneous firing of a large-calibre barrel and the rifled round.

The trigger system for the rifled round comprises two safety mechanisms, namely a hammer safety mechanism and a double sear, said system also comprising a special snap-action mechanism in order to make release more sensitive if it has previously been activated.

Advantageously, the weapon has a fast laser-beam sighting system.

BRIEF DESCRIPTION OF THE DRAWINGS

The invention is explained below in greater detail, reference being made to the accompanying drawings in which.

DESCRIPTION OF THE INVENTION

Figure 12:
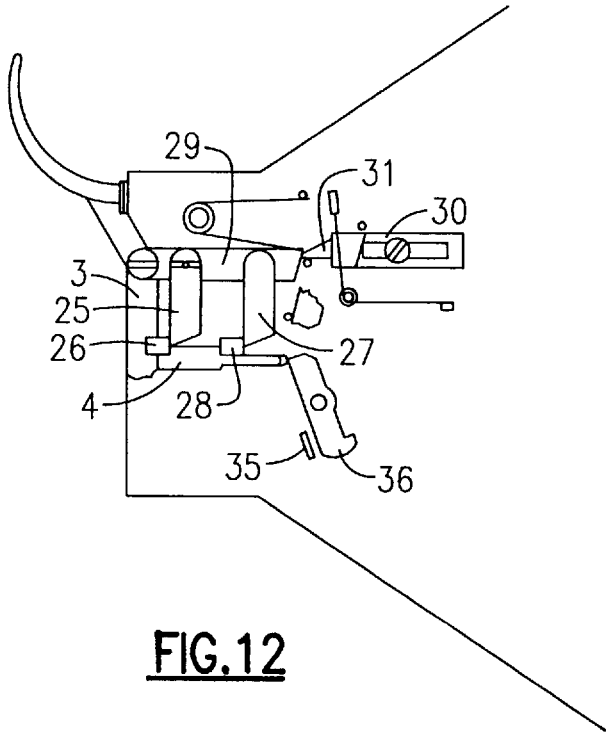
FIG. 12 is a view showing the snap-action trigger system.

The action is fixed vertically behind the breach plate (0) whereas the hammers are opposite each other and have an external handle (1) for ergonomic cocking using the thumb and index finger. The firing mechanism associated with each barrel is of a conventional well known design. Each hammer (1) is manually movable to a cocked position and is held cocked by one of the two sears (36). As best shown in FIG. 12, the sears are coupled to the trigger (2) by a positionable pusher pin (4). A selector (6) allows the pusher pin to be moved between a first position in operable contact with the sear associated with the upper barrel, a second position in operable contact with the sear associated with the lower barrel and a third position free of the two sears (36), the purpose of which will be explained in greater detail below. To fire the upper barrel, upper barrel sear is selected and the hammer associated with that barrel is cocked. The sear functions to hold the hammer cocked in a conventional manner. Pulling the trigger a given distance releases the hammer from the sear whereupon the hammer is permitted to strike a projectile in the barrel causing it to fire. A stop (35) associated with each sear (36) limits the amount of travel afforded the trigger when the pusher pin is in either the first or second position. This amount of travel is about one third of the full trigger travel.

The trigger (2) is in an inverted position and its vertical back (3) acts on a pusher pin (4) held in a component of a selector that slides in a vertical direction.

The external control of the selector (5) is located on the left side plate (7) and is in the form of a three-position click-stop ball and spring button (6). These positions are: an upper position for using the top barrel, a middle safety position function of which will be explained in greater detail below and a lower position for using the bottom barrel.

The action and the trigger system are built into a housing composed of two side plates (7) arranged vertically behind the breach plate (0) and joined to the latter so as to make the entire assembly rigid.

Figure 1:
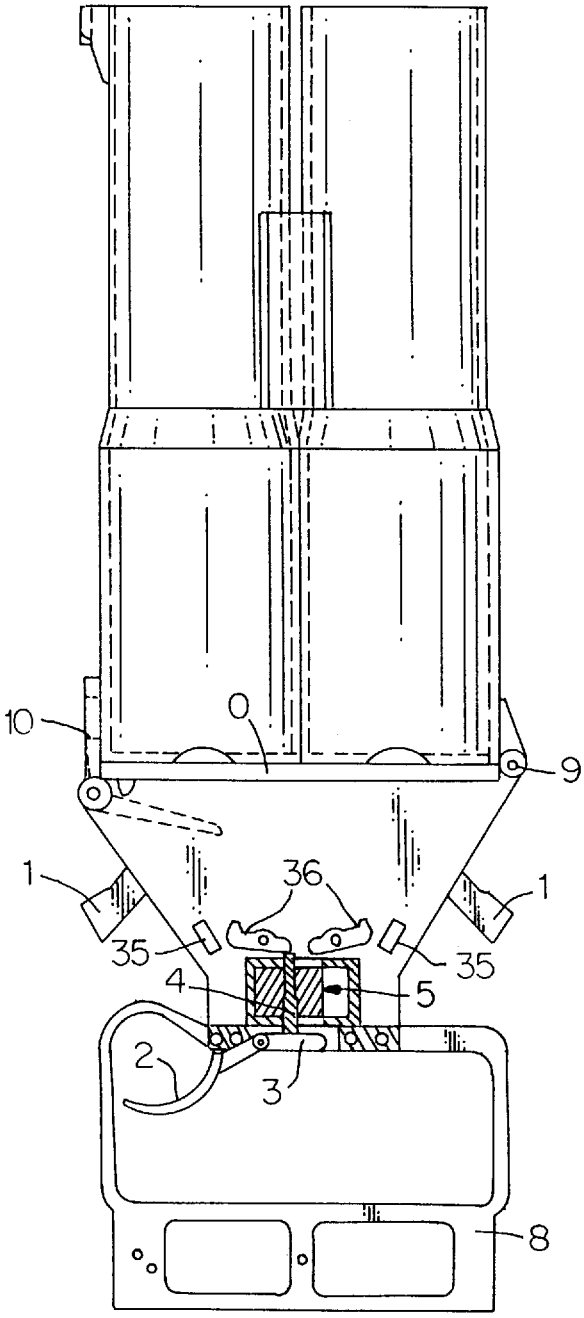
FIG. 1 is a side view of the weapon according to the invention showing the trigger system and the selector.
Figure 2:
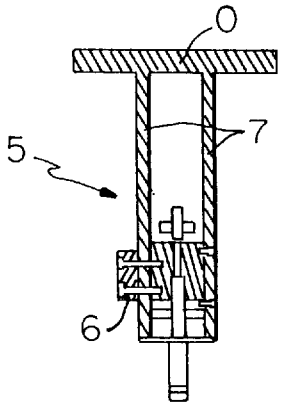
FIG. 2 is a top view of the selector.
Figure 3:
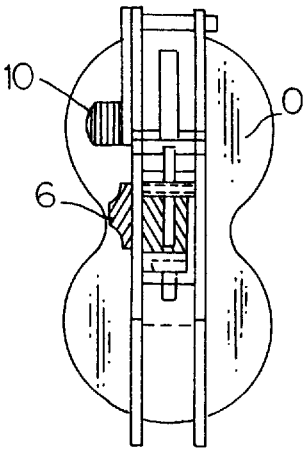
FIG. 3 is a rear view of the weapon.
Figure 4:
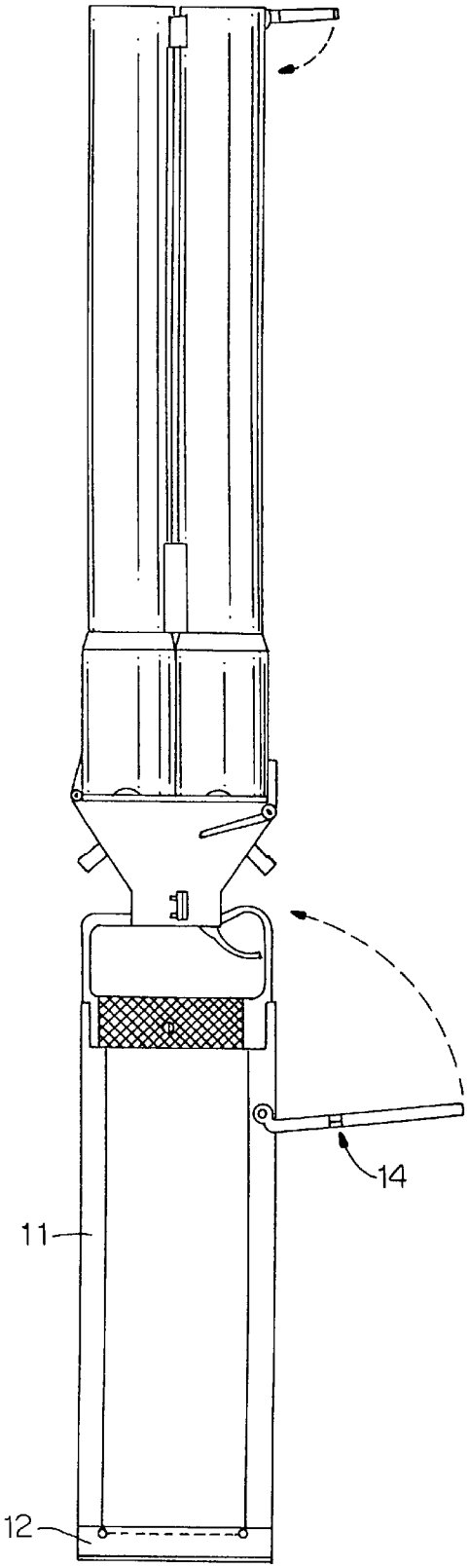
FIG. 4 is a side view of the weapon in its position of normal use.
Figure 5:
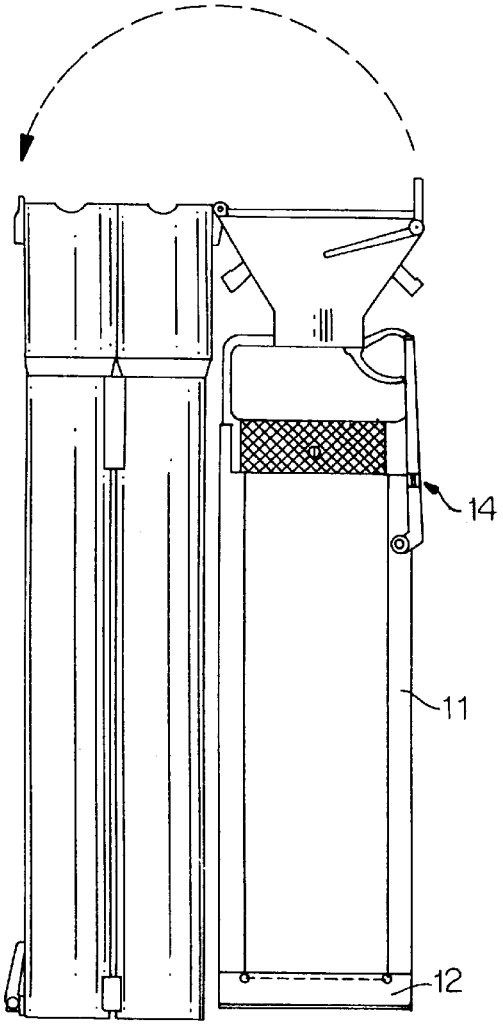
FIG. 5 is a view corresponding to FIG. 4 with the barrels folded.
Figure 6:
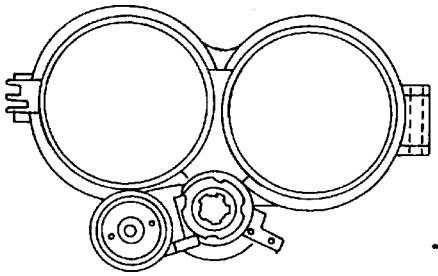
FIG. 6 is an end-on view corresponding to FIG. 7.
Figure 7:
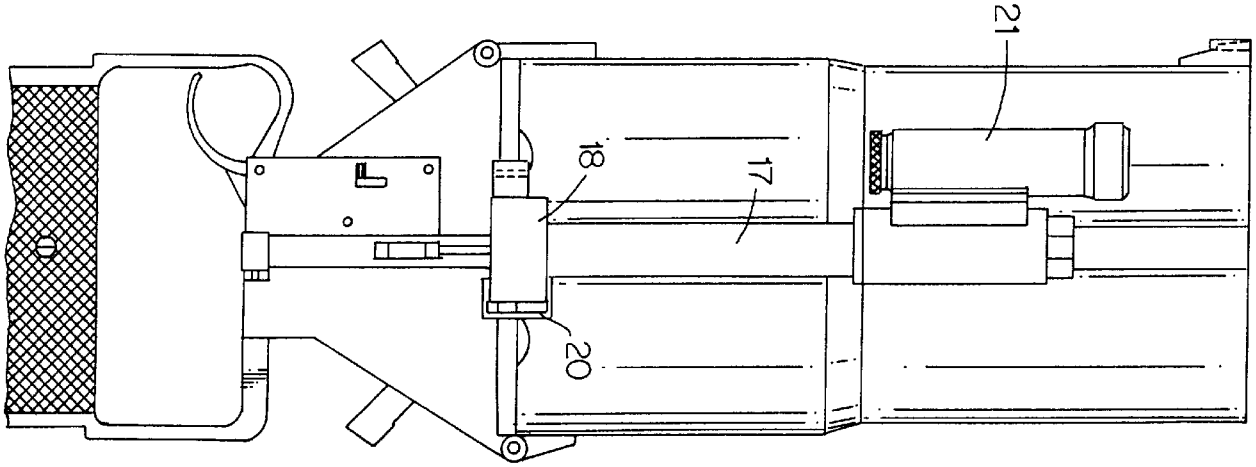
FIG. 7 is a side view of the weapon fitted with a third barrel.
Figure 8:
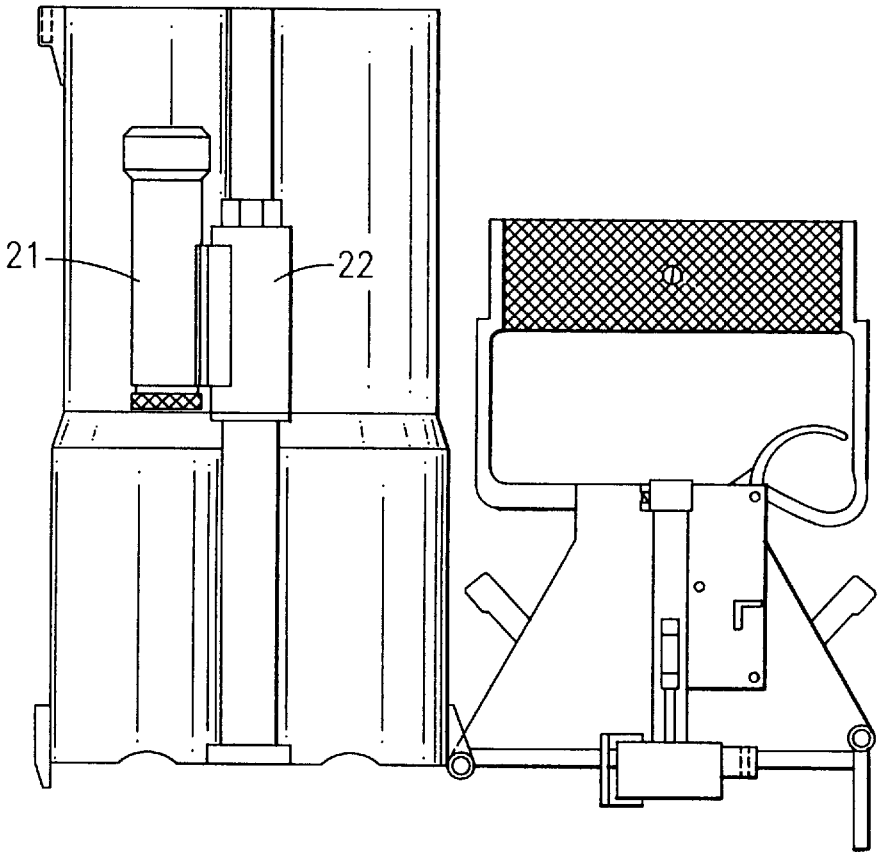
FIG. 8 is a view corresponding to FIG. 7 with the barrels folded.
Figure 9:
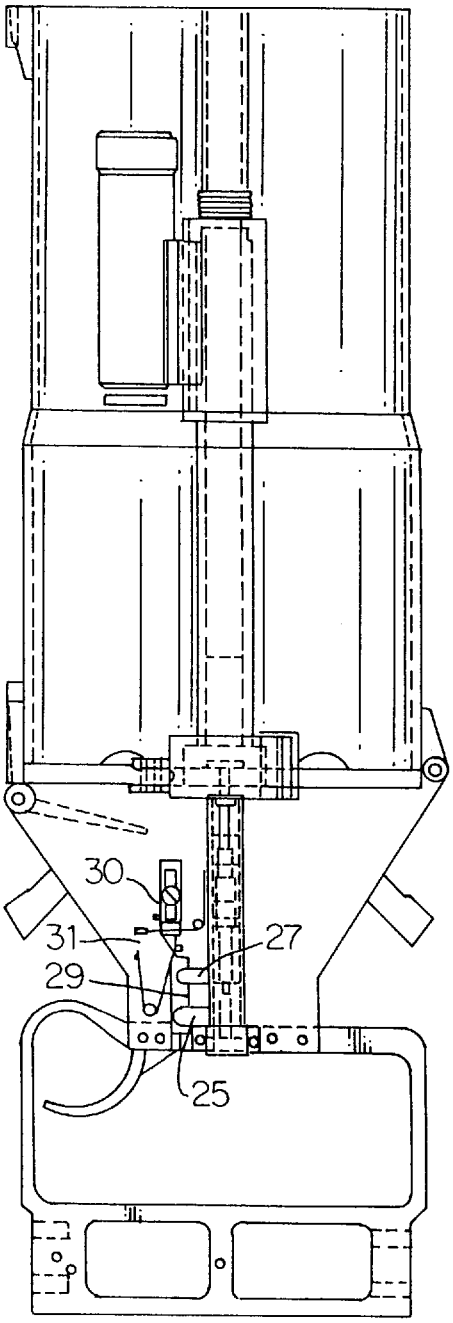
FIG. 9 is a view showing the trigger and firing system in the case of a weapon with over and under barrels fitted with a third barrel.
Figure 10:
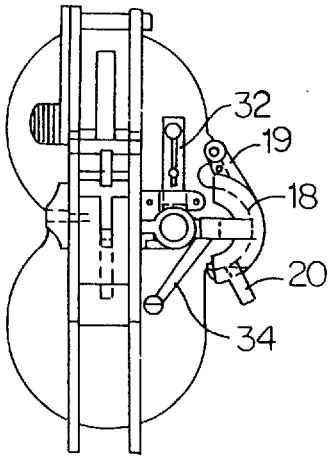
FIG. 10 is a view showing the rear locking of the third barrel.
Figure 11:
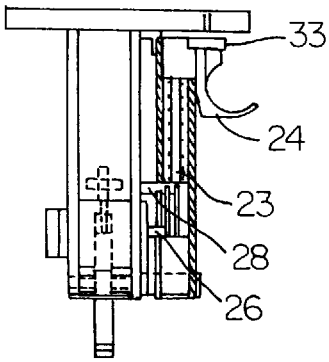
FIG. 11 is a view showing the firing system of the third barrel.

A grip (8) is attached to the back of the side plates (7) and is in alignment with the barrel/breach/action assembly. As clearly illustrated in FIG. 3, the grip (8) and side plates (7) are substantially contained within a volume described by the upper and lower barrels.

A swivel pin (9) links the rear of the lower barrel to the side plates (7) which extend beyond the bottom and the top of the breach plate. The bolt is hinged on the side plates with the base of the bolt being fixed at the top and the rear of the top barrel, the bolt is controlled by a locking bar on the left-hand side of the action housing (10).

The long model (shoulder-fired weapon) is equipped with a U-shaped metal stock which is screw fastened to the top and the bottom of a grip (11). An end piece (12) of variable thickness made of moulded plastic is permanently attached to the end of the grip (11).

Since the mechanical sighting system varies from one model to another, the hand-held weapon intended mainly for a flat trajectory is fitted with a fixed device, a sight with a notch in the bolt and its rear sight and protected front sight mounted on a ramp at the tip of the top barrel.

The shoulder-fired weapon is mainly intended for a curved trajectory and has a wide-angle foldable sighting device on the top of the stock. A peep sight (14) extends the line of aiming relative to the raised, foldable front sight at the tip of the top barrel (13).

Locking of the third barrel (17) on the breach plate is ensured over a semicircular reach of 170° by a bolt of the same arc (18) kept open by a ball ratchet (19) and closed by a latch (20).

A laser sight (21) fixed on the sleeve (22) of the barrel allows fast, accurate aiming by positioning a light point on the target. A switch (not shown) protected by a rubber guard is mounted underneath the bottom barrel where it is supported by the hand and hand pressure switches on the laser system.

Detonation in order to fire the rifled round is obtained by a system with an axial hammer (23) of a well known conventional design having a firing pin (33) mounted in a slidable hammer post (26). The axially movable hammer assembly is fixed against the right side plate (7). Manual cocking is obtained by means of ball control (24) held by sear (25) that acts on hammer post (26). A second longer safety sear (27) acts on the front hammer post (28).

The two sears (25 and 27) are controlled by a second trigger back piece mounted horizontally by fitting it into the end of a trigger lever (29). The lever arm thus formed releases the position of sear (27) when ⅔ pressure is exerted on the trigger, the last ⅓ preparing for firing by releasing sear (25).

Firing, when sear (25) is released, can be made more sensitive by previously activating a snap-action system (30) that is placed in compression at the end of trigger lever (29). The ramp of component (31) is forced underneath trigger lever (29) and fulfils this function without any action by the marksman's finger.

In the lower position, safety mechanism (32) places a small metal plate between the breach plate and the tip of the hammer assembly, thus preventing striking of a projectile by the firing pin (33) mounted on kickover spring (34).

The striking mechanism, controlled by a single trigger is designed so that simultaneous firing of two rounds is made impossible even if the three hammers are cocked and the safety is off.

Figure 13A:
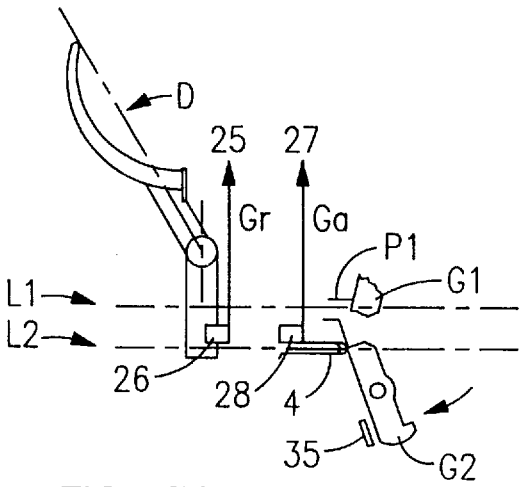
FIGS. 13A and 13B are a view showing the safety system for firing the rounds.
Figure 13B:
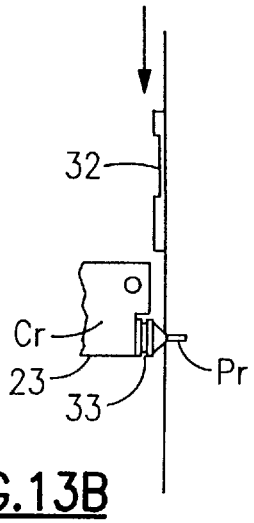

FIGS. 12 and 13 show a situation where the three hammers are cocked and the safety mechanism (32) for the rifled round is not in the lower position. The selector is set to one of the smooth large-bore rounds (L2), pusher pin (4) is opposite the sear (36).

In this case, a pressure exerted on trigger (2) equal to 2 mm which is transmitted by lever (3) to pusher pin (4) produces forward movement of the latter equal to 1 mm taken up from sear (36), this amount of travel being sufficient to fire the smooth large-bore round (L2). The sear limit stop (35) limits the travel of the components used as defined in this case (firing one of the smooth large-bore rounds).

Firing the rifled round requires a travel defined as 6 mm on the trigger, this travel is exclusively obtained when the selector is in the middle position with pusher pin (4) moving freely between sears (36, 36), a position normally defined when there is a requirement to fire the rifled round and prevent the possibility of firing large-calibre rounds.

The advantages are clearly apparent from the description.

I claim:

1. A firearm that includes:

an upper barrel and a lower barrel mounted in superposition one over the other upon a rear breach plate, a gripping means rotatably mounted upon said breach plate so that the gripping means is rotatable about 180° between a first operative position along the axis of symmetry of the superimposed barrels and a stored position parallel to the superimposed barrels, said gripping means having a size and shape such that it is contained within a volume substantially described by the upper and lower barrels when said gripping means is in said operative position, said barrels having an axial length that is greater than that of the gripping means, and firing means mounted inside said gripping means that further includes a finger engagable trigger that is mounted in an inverted position so that it points upwardly relative to the lower barrel.

2. The firearm of claim 1 wherein said firing means includes a first sear for releasably holding a first hammer associated with the upper barrel in a cocked position, a second sear for releasably holding a second hammer associated with the lower barrel in a cocked position, a positionable pusher pin connected to said trigger for releasing a selected one of said sears, when the trigger is pulled and a selector means mounted upon said gripping means for positioning said pusher pin in a first position for engaging said first sear, in a second position for engaging said second sear, and a third position wherein the pusher pin is disengaged from both the first sear and the second sear.

3. The firearm of claim 2 that further includes stop means associated with the first and second sears for limiting the travel of said trigger to about one third the full travel afforded said trigger when either the first or the second sear is selected.

4. The firearm of claim 3 that further includes a third rifled barrel mounted upon the breach plate that is parallelly aligned with the upper and lower barrels.

5. The firearm of claim 4 wherein said firing means further includes an axially movable hammer for firing a projectile in said third rifled barrel, said axially movable hammer being manually positionable into a cocked position by a ball control cocking arm attached to said axially movable manner.

6. The firearm of claim 5 that further includes a third sear and a fourth sear for releasably holding the axially movable hammer in a cocked position when said selector means is in the third position, a trigger lever connected to said trigger and being coupled to the third and fourth sears for releasing the third sear from engagement with the axially movable hammer when the trigger is pulled to about two thirds of its full travel, and releasing the fourth sear from engagement with the axially movable hammer when the trigger is pulled to about its full travel.

7. The firearm of claim 6 that further includes manually actuated safety means operatively associated with the axially movable hammer that includes a plate that is insertable between the axially movable hammer and the breach plate when the axially movable hammer is in the cocked position and slide means for inserting and removing the plate from between the axially movable hammer and the breach plate.

8. The firearm of claim 6 that further includes a spring biased ramp that is movable into contact with said trigger lever for urging said trigger lever into releasing contact with said third and fourth sears to lessen the amount of pressure that must be exerted on the trigger to release said third and fourth sears.

* * * * *